United States Patent [19]

Ishikawa et al.

[11] Patent Number: 4,739,938

[45] Date of Patent: Apr. 26, 1988

[54] MEDIA AGITATING TYPE GRINDING MACHINE

[75] Inventors: Tsuyoshi Ishikawa; Kazuhiro Ishigaki, both of Tochigi, Japan

[73] Assignee: Mitsui Miike Kakoki Kabushiki Kaisha, Tochigi, Japan

[21] Appl. No.: 904,395

[22] Filed: Sep. 8, 1986

[30] Foreign Application Priority Data

Jan. 14, 1986 [JP] Japan ..... 61-3467[U]

[51] Int. Cl.[4] ..... B02C 17/16

[52] U.S. Cl. ..... 241/171; 241/172

[58] Field of Search ..... 241/98, 301, 171, 172

[56] References Cited

U.S. PATENT DOCUMENTS

| | | | |
|---|---|---|---|
| 1,129,866 | 3/1915 | Hamel | 241/98 X |
| 2,764,359 | 9/1956 | Szegvari . | |
| 3,149,789 | 9/1964 | Szegvari . | |
| 3,212,722 | 10/1965 | Maeder et al. | 241/171 |
| 3,522,934 | 8/1970 | Walter | 241/98 X |

FOREIGN PATENT DOCUMENTS

| | | | |
|---|---|---|---|
| 1368632 | 10/1974 | United Kingdom . | |
| 948435 | 8/1982 | U.S.S.R. | 241/171 |

OTHER PUBLICATIONS

Increase Production, Reduce Costs for Chip Quality Dispersions, American Ink Maker, 12-1983.
Technical Information Leaflet 7901.

*Primary Examiner*—Mark Rosenbaum
*Attorney, Agent, or Firm*—Renner, Kenner, Greive, Bobak & Taylor

[57] ABSTRACT

An improved grinding machine of the type in which raw material to be ground is agitated in the presence of a large number of grinding media is installed in the horizontal posture. An inner tube through which raw material is introduced into the interior of a grinding tank is fitted to a raw material inlet port which is disposed on the upper outer surface of the grinding tank at the one end of the latter. The inlet port is designed in the tubular configuration extending upwardly of the grinding tank and has a flange at the uppermost end thereof to which a flange on the inner tube is fastened. The inner tube is equipped with a vibrator adapted to be periodically actuated by compressed air or the like medium of which supply is controlled by means of a control valve. The vibrator may be actuated under the effect of electromagnetic force. The inner tube is joined to a raw material feed tube via a flexible joint tube which is interposed therebetween.

3 Claims, 2 Drawing Sheets

PRIOR ART

MEDIA AGITATING TYPE GRINDING MACHINE

BACKGROUND OF THE INVENTION

1. Field of the Invention

The present invention relates to a grinding machine of the type in which raw material to be ground is agitated in the presence of a large number of grinding media and more particularly to improvement of a grinding machine of the above-mentioned type.

2. Description of the Prior Art

There is already known a media agitating type grinding machine which is so constructed that a rotational shaft with a number of agitating rods fitted thereto is extended through a grinding tank which is installed in the horizontal posture and grinding is achieved under the effect of agitation of the agitating rods while raw material to be ground is mixed with the media as the rotational shaft is rotated. Since it is found that this type of grinding machine consumes less power than conventional ball mill or the like, the former has been widely put in practical use in many industrial fields.

As mentioned above, the media agitating type grinding machine has wide application fields which have increased year by year but it is pointed out as a drawback inherent to the grinding machine that when raw material having high adhesiveness is ground, it tends to be adhesively deposited on the inner wall of a raw material inlet port. To obviate the drawback there was proposed a grinding machine which was equipped with a breaker at the inlet port. To facilitate understanding of the present invention it will be helpful that the proposed grinding machine will be described below with reference to FIGS. 2 and 3.

FIG. 2 is a fragmental vertical sectional view of the grinding machine, particularly illustrating how the inlet port is constructed and FIG. 3 is a plan view of the grinding machine in FIG. 2. A pneumatical cylinder 28 is pivotally mounted on a bracket 30 with the aid of a trunion 29. A piston 31 extends forwardly of the pneumatical cylinder 28 and carries an arm 25 at the foremost end thereof with the use of a pin 24 while the lowermost end of the arm 25 is operatively connected to a shaft 26. As will be best seen in FIG. 3, the shaft 26 extends across the inlet port in the horizontal direction and a breaker 27 is turnably mounted on the shaft 26.

As the pneumatical cylinder 28 is operated, the piston 31 is reciprocably displaced and thereby the breaker 27 is caused to turn in both the directions as identified by arrow marks in FIG. 2, resulting in raw material deposited on the inner wall of the inlet port being removed therefrom.

However, it is found that the proposed grinding machine has another drawback that an effective working space is reduced due to existence of the breaker and unexpectedly this leads to promotion of deposition of raw material on the inner wall of the inlet port. Further, since the breaker 27 is caused to turn about the central shaft 26, it results that raw material deposited in the corner area of the inlet port cannot be completely removed. Moreover, due to the fact that the shaft 26 should be mounted in such a manner as to extend through both the side walls of the inlet port there is a necessity for gastightly sealing the parts of the side walls through which the shaft 26 extends.

SUMMARY OF THE INVENTION

Thus, the present invention has been made with the foregoing background in mind and its object resides in providing an improved grinding machine of the early-mentioned type which is entirely free from the drawbacks inherent to the conventional grinding machine.

To accomplish the above object there is proposed according to the present invention a grinding machine of the type in which raw material to be ground is agitated together with a large number of media, the grinding machine being installed in the horizontal posture, wherein the improvement comprises an inner tube which is fixedly fitted to a raw material inlet port which is disposed on the upper outer surface of a grinding tank at the one end of the latter so as to allow raw material to be introduced into the interior of the grinding tank therethrough, the inner tube being equipped with a vibrator adapted to be actuated periodically.

The inner tube is jointed to a raw material feed tube via a flexible joint tube which is interposed therebetween.

Usually, the vibrator is actuated by compressed air or the like medium of which supply is controlled by means of a control valve.

Since the inner tube through which raw material to be ground is introduced into the grinding tank is formed with no projection in the space as defined by the inner wall thereof, it is assured that raw material flows smoothly through the inner tube with minimized occurrance of deposition of raw material on the inner wall of the inner tube and raw material adhesively deposited thereon is periodically removed without fail under the influence of vibration generated by means of a vibrator which is attached to the inner tube.

Other objects, features and advantages of the present invention will become readily apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Now, the present invention will be described in a greater detail hereunder with reference to the accompanying drawings which schematically illustrate a grinding machine in accordance with an embodiment thereof.

Figure 1:
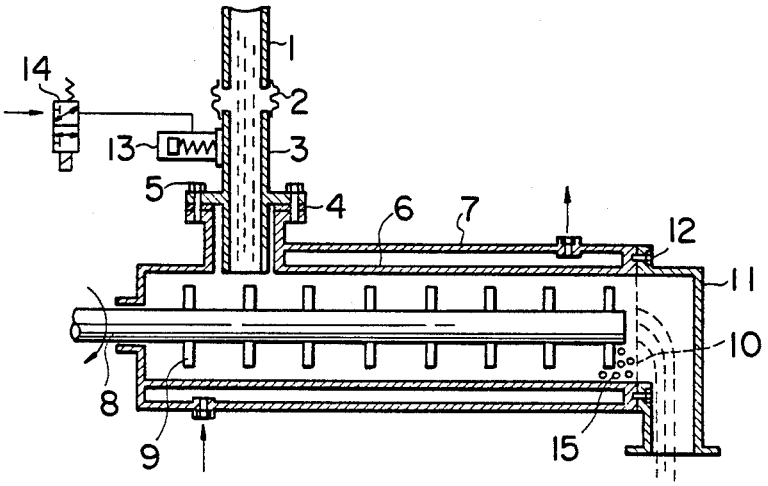
FIG. 1 is a vertical sectional view of a grinding machine of the early-mentioned type in accordance with an embodiment of the invention.
Figure 2:
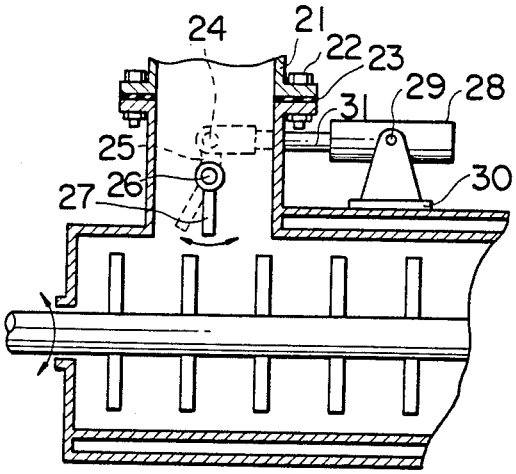
FIG. 2 is a fragmental vertical sectional view of a conventional grinding machine.
Figure 3:
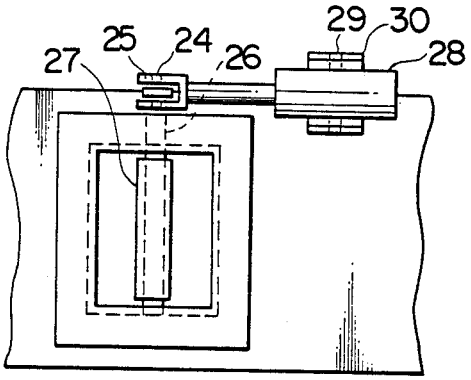
PRIOR ART FIG. 3
FIG. 3 is a plan view of the grinding machine in FIG. 2.

In FIG. 1 reference 1 designates a feed tube which extends from a constant rate feeder (not shown). As will be apparent from the drawing, the feed tube 1 is jointed to an inner tube 3 via a flexible joint tube 2. The inner tube 3 is fastened to a raw material inlet port on the grinding tank 6 with the use of a packing 4 made of soft elastic material by means of a plurality of bolts 5 while the packing 4 is interposed between the flange portion of the inner tube 3 and the flange portion of the inlet port. As shown in the drawing, the inlet port is designed in the tubular configuration which extends upwardly of the upper outer surface of the grinding tank 6 at the left end area of the latter as seen in the drawing. The lower end of the inner tube 3 is projected downwardly to the position where it is located in horizontal alignment with the inner upper wall of the grinding tank 6. The inner tube 3 is equipped with a vibrator 13 on the left side thereof. The vibrator 13 is adapted to actuate under the effect of compressed air or the like medium of which supply is controlled by means of a control valve 14.

A rotational shaft 8 is arranged in the interior of the grinding tank 6 while extending in the horizontal direction and a number of radially extending agitating rods 9 are fixedly fitted to the rotational shaft 8. A large number of media 15 are accomodated in the grinding tank 6 and as the rotational shaft 8 is rotated, grinding of raw material is effected under the effect of cooperation of the media 15 with the agitating rods 9. The grinding tank 6 is provided with a screen 10 at the right end thereof which is stretched over the whole open area of the grinding tank 6 whereby ground material is separated from the media 15. A discharge bath 11 is attached to the right end of the grinding tank 6 by means of a plurality of bolts 12. A cooling jacket 7 is arranged around the outer surface of the grinding tank 6.

Next, operation of the grinding machine of the invention will be described below.

Raw material to be ground is delivered from the feeder (not shown) at a constant rate of feeding and it is then introduced into the interior of the grinding tank 6 via the feed tube 1, the flexible joint tube 2 and the inner tube 3. Thereafter, it is subjected to grinding in the grinding tank 6 while it is agitated together with the media 15 by means of the agitating rors 9. After completion of grinding, ground material is separated from the media 15 with the aid of the screen 10 and it is then discharged from the grinding tank 6 via the discharge bath 11.

The vibrator 13 is periodically actuated by compressed air or the like medium which is periodically supplied from supply source under control of the valve 14. Since the inner tube 3 is periodically vibrated by means of the vibrator 13, raw material deposited on the inner wall of the inner tube 3 can be completely removed therefrom under the effect of periodical vibration and thereby it can be supplied into the grinding tank 6 without fail. It should be noted that the lower end of the inner tube 3 is projected downwardly to the position where it is located in horizontal alignment with the upper inner wall surface of the grinding tank 6. Thus, raw material can be introduced from the inner tube 3 directly into the working area where the media 15 are present whereby it is easy to be mixed with the media 15.

As will be readily apparent from the above description, the grinding machine of the invention has advantageous features that no raw material is adhesively deposited over the inner wall of the inner tube 3, long durability is assured owing to the fact that the machine has no sliding part and sealing is easily achieved for the machine.

While the present invention has been described only with respect to a single preferred embodiment, it should of course be understood that it should not be limited only to this but various changes or modifications may be made in any acceptable manner without departure from the spirit and scope of the invention as defined by the appended claims.

What is claimed is:

1. In a grinding machine of the type in which raw material to be ground is agitated together with a large number of media, said grinding machine being installed in the horizontal posture, the improvement comprising an inner tube which is fixedly fitted to a raw material inlet port which is disposed on the upper outer surface of a grinding tank at the one end of the latter so as to allow raw material to be introduced into the interior of the grinding tank therethrough, said inner tube being equipped with an exeriorly attached vibrator actuated by compressed air which is periodically supplied thereby effecting vibration of said inner tube to help remove raw material deposited on the inner wall of the inner tube.

2. A grinding machine as defined in claim 1, wherein the inner tube is jointed to a raw material feed tube via a flexible joint tube which is interposed therebetween.

3. A grinding machine as defined in claim 1, wherein the raw material inlet port is designed in the tubular configuration extending upwardly of the upper outer surface of the grinding tank and has a flange at the uppermost end thereof to which a flange on the inner tube is fastened by means of a plurality of bolts.

* * * * *